US005312002A

United States Patent [19]

DiCicco

[11] Patent Number: 5,312,002

[45] Date of Patent: May 17, 1994

[54] UTILITY TRAY

[76] Inventor: Thomas DiCicco, 50 Williams St., Mercerville, N.J. 08619

[21] Appl. No.: 980,455

[22] Filed: Nov. 23, 1992

[51] Int. Cl.[5] ..... A47F 5/00

[52] U.S. Cl. ..... 211/88

[58] Field of Search ..... 211/88; 248/231.7; 108/152

[56] References Cited

U.S. PATENT DOCUMENTS

| | | | |
|---|---|---|---|
| 477,355 | 6/1892 | Curtis et al. | 211/88 |
| 1,108,692 | 8/1914 | Burd | 211/88 X |
| 1,662,293 | 3/1928 | Bennett . | |
| 2,562,322 | 10/1950 | Black | 248/231.7 X |
| 2,710,643 | 6/1955 | Wincey et al. | 248/231.7 X |
| 3,269,551 | 8/1966 | Hertzel | 211/88 |
| 3,301,406 | 1/1967 | Scott | 211/88 |
| 3,567,038 | 3/1971 | Ammann | 211/88 |
| 3,697,033 | 10/1972 | Jacobs | 248/231.7 |
| 3,904,041 | 9/1975 | Medgebow | 211/88 X |
| 4,605,131 | 8/1986 | Debus et al. . | |
| 4,730,760 | 3/1988 | Keller . | |
| 5,078,281 | 1/1992 | Johnson | 211/88 |

*Primary Examiner*—Robert W. Gibson, Jr.
*Attorney, Agent, or Firm*—Watov & Kipnes

[57] ABSTRACT

A device for attaching to a horizontally extending ledge of a wall mounted device which includes a tray and an attachment mechanism for securing the tray to the ledge in a position substantially parallel to the ledge. The device has particular application to the repair and/or installation of circuit breaker panels.

6 Claims, 3 Drawing Sheets

UTILITY TRAY

FIELD OF THE INVENTION

The present invention is generally directed to a utility tray for attaching to a horizontally extending surface. The tray may be used to support tools, electrical equipment and the like. In particular, the utility tray attaches to the horizontally extending ledge of a circuit breaker panel and can be conveniently used by electricians during the installation and/or repairs of the circuit breaker panel.

BACKGROUND OF THE INVENTION

The installation and/or repair of devices which are mounted on a vertical surface is rendered more difficult because there is no convenient area to place tools and equipment needed to complete the job. For example, in the installation and/or repair of circuit breaker panels, the electrician may place his tools and component parts of the panel on the floor. Every time a new tool is needed or component part must be inserted into the panel, the electrician must stop work, reach down to the floor and obtain the tool or component part, and then stand erect to begin work again. This procedure results in considerable loss of work time.

Electricians often wear tool belts to house at least some of the tools needed to install or repair a circuit breaker panel. The tool belts are typically worn around the waist and a variety of slots and pockets for holding hammers, pliers, screwdrivers and the like.

While such tool belts are useful for keeping the tools off the floor, they do not provide a place for easy access to the component parts of the circuit breaker. All too often the electrician places the component parts on the horizontally extending ledge of the circuit breaker panel. However, the area formed by the horizontally extending ledge is inadequate to store all the component parts needed during a routine installation and/or repair. In addition, component parts stored in this area can interfere with the electricians movements within the panel and can result in the component parts accidentally falling to the ground.

It would, therefore, be of considerable benefit to provide a convenient place for storing tools and component parts of a device to be installed on a wall, such as, for example, a circuit breaker panel which can be readily installed and removed as desired.

SUMMARY OF THE INVENTION

The present invention is generally directed to an apparatus which is adapted to attach to a horizontally extending ledge of a wall mounted device. By way of example only, the wall mounted device can be a circuit breaker panel which typically has a horizontally extending ledge beneath the panel door which is exposed when the panel door is opened.

The apparatus comprises a tray having a base and an attachment means operatively connected to one edge of the tray for engaging the ledge of the wall mounted device while maintaining the tray substantially parallel to the ledge. The present apparatus therefore provides an area for the storage of tools, component parts of the wall mounted device and the like which is convenient and eliminates the need for placing objects on the floor or on the ledge of the wall mounted device. The apparatus is also portable so that it may be readily moved from one job site to another.

In a preferred form of the invention, the attachment means comprises a clamping means which operatively engages the ledge to secure the tray in its horizontally extending position. A variety of clamping devices may be used which will depend, in part, on the degree of support needed for the tray and the dimensions of the ledge of the wall mounted device.

BRIEF DESCRIPTION OF THE DRAWINGS

The following drawings are illustrative of embodiments of the invention and are not intended to limit the invention as encompassed by the claims forming part of the application.

DETAILED DESCRIPTION OF THE INVENTION

Figure 1:
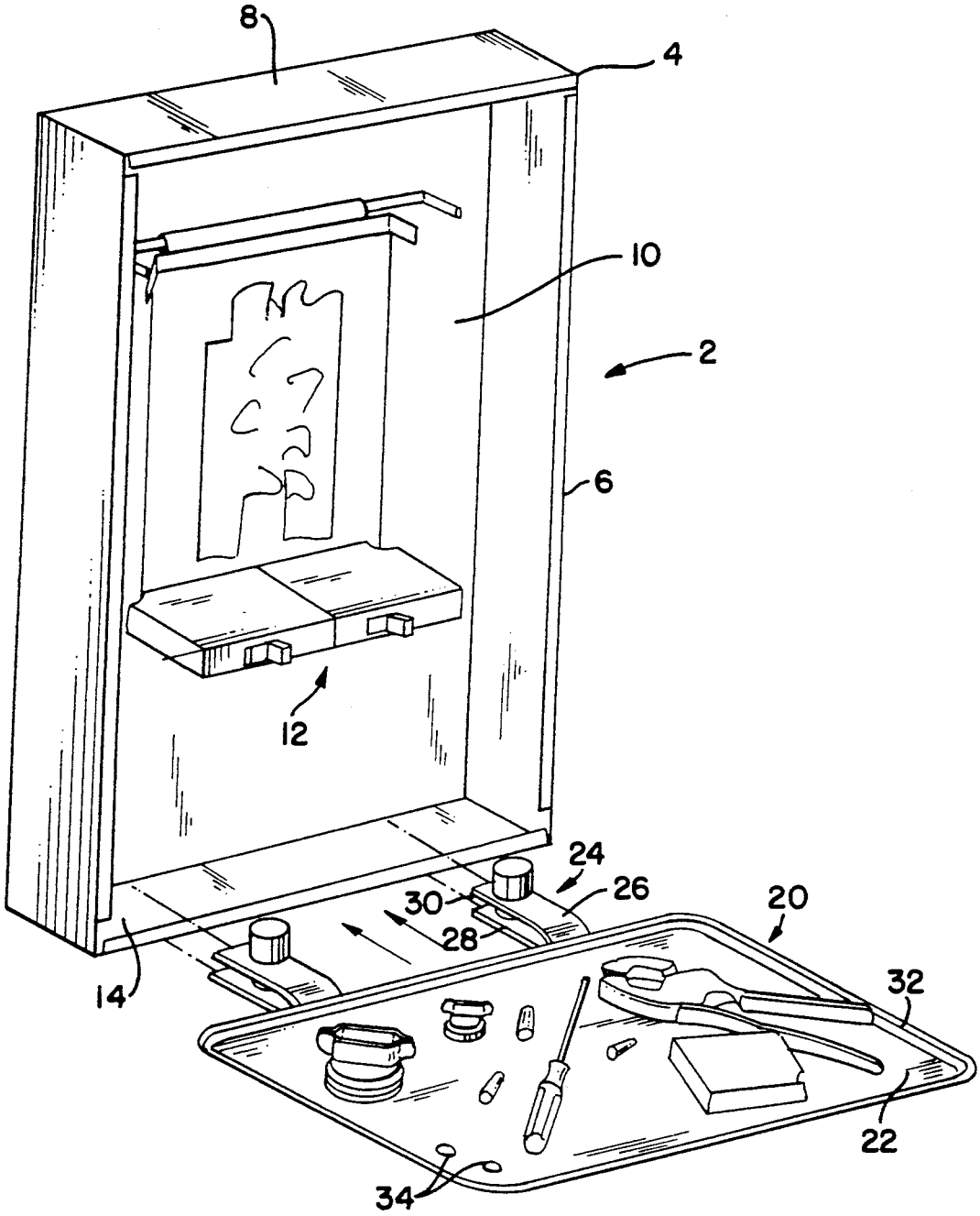
FIG. 1 is a perspective view of one embodiment of the invention shown in proximity to a circuit breaker panel.
Figure 2:
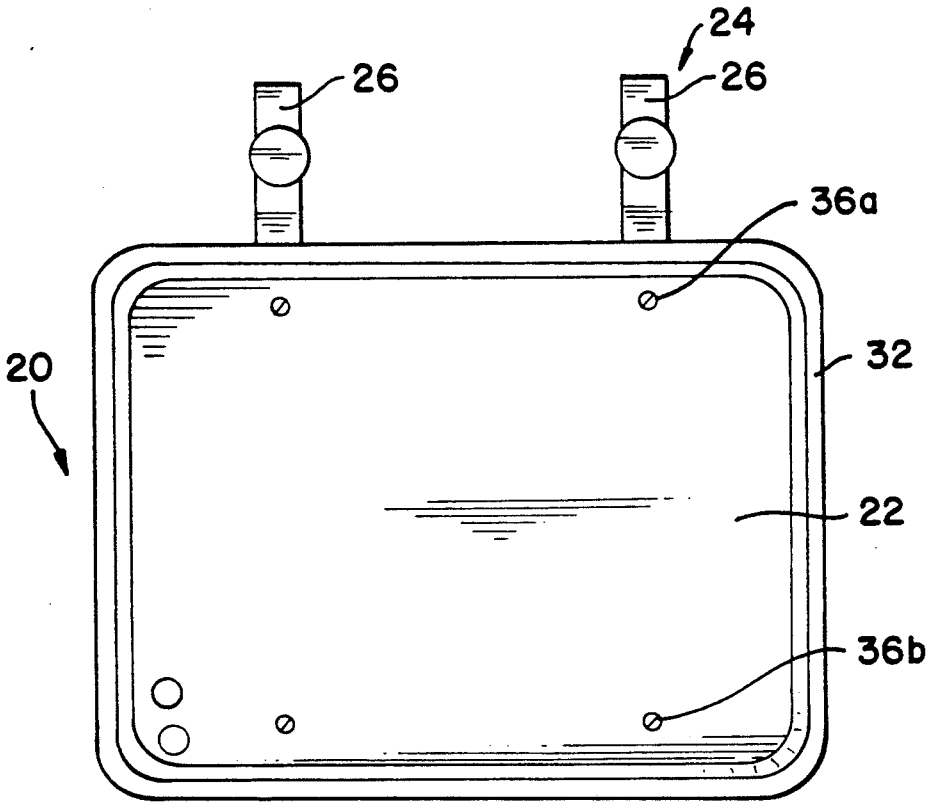
FIG. 2 is a top view of the embodiment of the invention shown in FIG. 1.

Referring to the drawings and in particular to FIGS. 1 and 2, there is shown a wall mountable device in the form of a circuit breaker panel 2 having a housing 4 including sides 6, a ceiling 8 and a back wall 10. The back wall 10 houses the circuit breakers and related electrical components shown generally for ease of illustration by numeral 12. The panel 2 also has a ledge 14 extending outwardly from the bottom of the back wall 10. In the customary installation and/or repair of circuit breaker panels 2, an electrician will often store circuit breakers and related electrical equipment, as well as tools, on the surface of the ledge 14. The ledge, however, does not provide sufficient surface area for this purpose and therefore the electrician is almost always forced to use other means (e.g., the floor) to store electrical equipment and tools which is time consuming and inefficient.

In accordance with the present invention, a tray has an attachment means uniquely suited to securely attach the tray to the ledge 14 of the circuit breaker panel 2 to provide a work surface for the equipment needed to install and/or repair a circuit breaker panel.

Referring again to FIGS. 1 and 2, the tray device designated generally by numeral 20 includes a base 22 which provides a work surface area. Attached to the base is an attachment mechanism 24 including at least one pair of spaced apart bars constituted by an upper bar 26 and a lower bar 28 (two pairs of such bars are specifically shown in the drawings). The bars 26, 28 diverge at one end and thereby form an opening 30 for receiving the ledge 14 as the tray 20 is inserted into operative engagement with the circuit breaker panel 2. The distance between the bars 26, 28 and, therefore, the width of the opening 30 is sufficient to enable the tray 20 to be inserted in the direction of the arrows into operative engagement with the ledge 14.

The tray 20 includes the base 22 which is of sufficient area to provide a suitable work surface. The width of the base of the tray, for use in the repair and/or installation of circuit breaker panel 2, is preferably limited to a size which enables the electrician to reach over the tray and into the circuit breaker panel 2. The preferred width of the base is no greater than about 24 inches.

The base 22 may also be provided with an upwardly extending rim 32, which surrounds the base 22, to provide depth to the work area and to prevent tools and the like from sliding off of the tray 20. There may also be provided, either in the base 22 or the rim 32, slots 34 for holding tools in an upright position.

Figure 3:
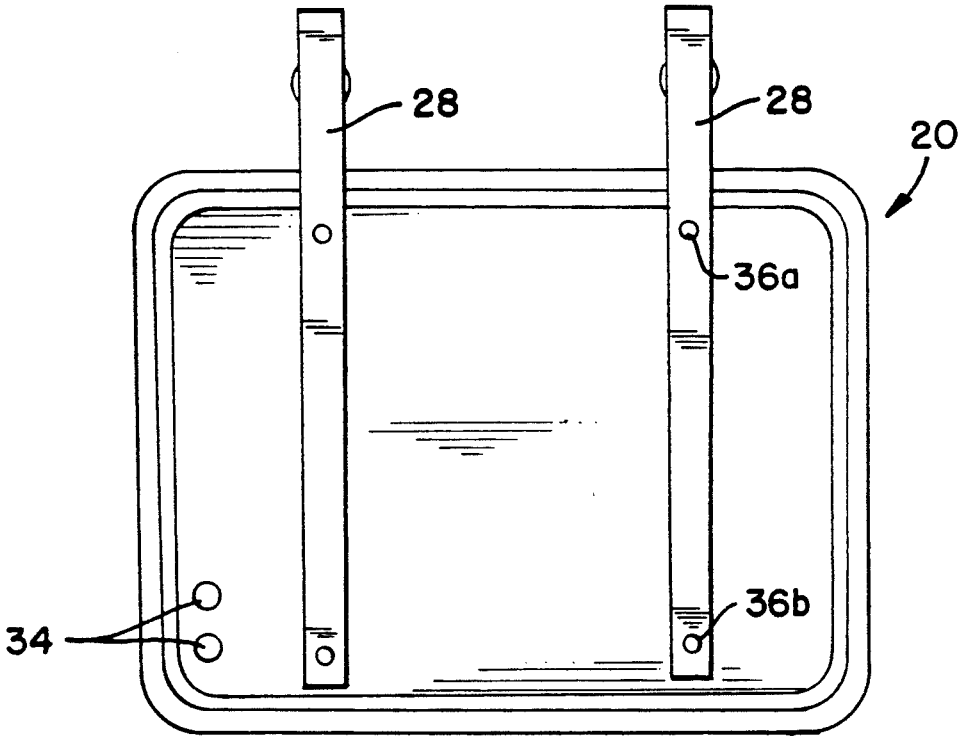
FIG. 3 is a bottom view of the embodiment of the invention shown in FIG. 1.
Figure 4:
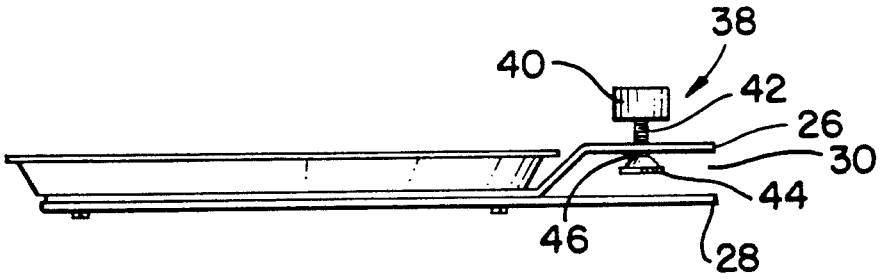
FIG. 4 is a side view of the embodiment of the invention shown in FIG. 1 in which a clamp for attaching the device to the ledge of a circuit breaker panel is in a non-engaged position.

As shown best in FIGS. 3 and 4, the upper and lower spaced apart bars 26, 28 of each pair converge beneath the tray and are secured to the underside of the tray 20 in a customary manner such as by bolts 36*a* and 36*b*.

Figure 5:
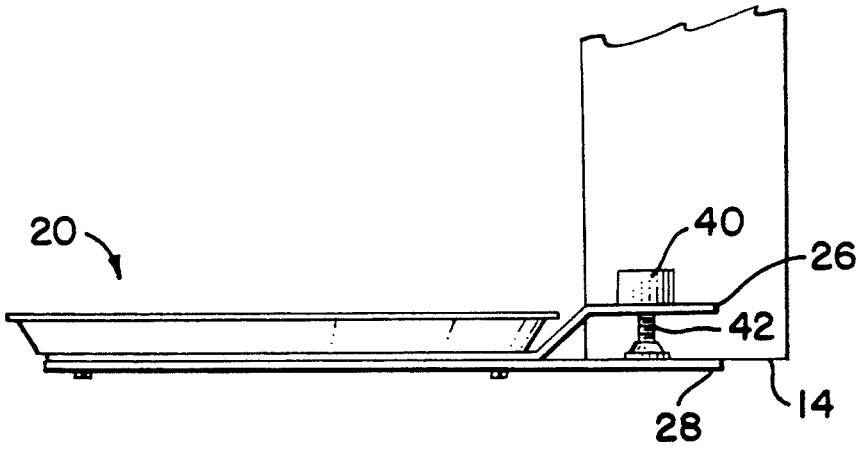
FIG. 5 is a side view similar to FIG. 4 showing the clamp in the engaged position and the tray secured in a horizontally extending position substantially parallel to the ledge of the circuit breaker panel.

The attachment mechanism 24, illustrated in the drawing figures and best shown in FIGS. 4 and 5, includes a clamp 38 including a rotatable handle 40, a stem 42 and a flattened contact surface 44 which engages the ledge 14 to secure the tray 20 to the circuit panel 2. The clamp 38 extends through a hole 46 in each of the upper bars 26.

The operation of the device of the present invention will now be explained.

Referring again to FIG. 1, the handle 40 of the clamp 38 is rotated in a counterclockwise manner so that the clamp 38 assumes the position shown in FIG. 4. As a consequence, a gap 48 is formed of sufficient height between the contact surface 44 and the lower bar 28 to enable the try 20 to enter into operative engagement with the ledge 14. The handle 40 of the clamp 38 is then rotated in a clockwise manner to lower the contact surface 44 so that it engages the surface of the ledge 14 as shown specifically in FIG. 5. The pressure exerted by the clamp 38 on the ledge 14 is sufficient to maintain the tray in a horizontally extending position, even with tools and component parts of the circuit breaker panel stored thereon.

The electrician may then place tools, component parts and the like on the tray as shown in FIG. 1 to install and/or repair the circuit breaker panel. When the work is complete, the electrician merely rotates the handles 40 of the clamp 38 in a counterclockwise direction so that the stem 42 moves from the engaged position shown in FIG. 5 to the disengaged position shown in FIG. 4. The tray 20 is then removed by withdrawing the tray 20 in the direction opposite to the direction of the arrows shown in FIG. 1.

Various changes to the embodiments shown and described herein may be made within the spirit and scope of the invention. For example, other attachment mechanisms may be employed for maintaining the tray in the desired horizontal position including the use of set screws, spring loaded clamps and the like.

I claim:

1. Apparatus adapted to be operatively engaged to a circuit breaker panel having a horizontally extending ledge comprising:

(a) a tray having a base and a first side; and (b) attachment means operatively connected to the tray for engaging the ledge of the circuit breaker panel so that the tray is in substantially the same plane as the ledge and so that the first side of the tray is adjacent the ledge.

2. The apparatus of claim 1 wherein the attachment means comprises clamping means comprising at least one pair of spaced apart bars having an opening therebetween at one end for receiving the ledge when the tray engages the circuit breaker panel, and means for contacting one of said bars and said ledge under pressure to thereby rigidly secure the tray to the ledge.

3. The apparatus of claim 2 wherein the tray is rectangular and the clamping means comprises at least two pair of spaced apart bars.

4. The apparatus of claim 1 wherein the tray further comprises a rim circumscribing the base, said base and rim forming a three dimensional space, for housing materials on the tray.

5. The apparatus of claim 2 wherein the spaced apart bars have a remote end secured to the underside of the base the tray.

6. The apparatus of claim 1 wherein the base has at least one through hole adapted to house a tool or component part of the circuit breaker panel.

* * * * *